US005893542A

United States Patent [19]

Hu

[11] Patent Number: 5,893,542

[45] Date of Patent: Apr. 13, 1999

[54] TOOL DISPLAYING DEVICE

[75] Inventor: Bobby Hu, Taipei, Taiwan

[73] Assignee: Hand Tool Design Corporation, Wilmington, Del.

[21] Appl. No.: 09/009,636

[22] Filed: Jan. 20, 1998

[51] Int. Cl.[6] ..... F16M 11/00

[52] U.S. Cl. ..... 248/176.1; 40/415; 211/70.6

[58] Field of Search ..... 248/166, 176.1, 248/291.1; 40/414, 115, 416; 211/70, 70.1, 70.6

[56] References Cited

U.S. PATENT DOCUMENTS 886,614 5/1908 Langedorf ..... 40/415

2,408,227 9/1946 Ramsey ..... 211/70.6

2,733,113 1/1956 Humbarger ..... 211/70.6

5,570,526 11/1996 Wallon ..... 40/748

*Primary Examiner*—Derek J. Berger

*Assistant Examiner*—Robert Lipcsik

*Attorney, Agent, or Firm*—Charles E. Baxley, Esq.

[57] ABSTRACT

A displaying device includes a first body and a second body which are pivotally connected. The first body includes a rotating member rotatably mounted thereto and an arcuate slot defined therein. A combination wrench is displayed on the displaying device with a box end thereof retained by an engaging member which may reciprocatingly slide along the arcuate slot upon activation of a driving mechanism.

6 Claims, 6 Drawing Sheets

TOOL DISPLAYING DEVICE

BACKGROUND OF THE INVENTION

1. Field of the Invention

The present invention relates to a tool displaying device and, more particularly, to a device for displaying a combination wrench, spanner, or the like.

2. Description of the Related Art

Wrenches, spanners, etc. are often displayed behind windowpanes or packaged and thus cannot attract the buyers as the buyers cannot touch them. The present invention is intended to provide a displaying device to solve this problem.

SUMMARY OF THE INVENTION

In accordance with the present invention, a displaying device is provided for an article of the type having a first end, a second end, and an intermediate portion between the first end and the second end. The displaying device includes a first body having a first end and a second end and a second body having a first end pivotally connected to the first end of the first body and a second end. The first body further includes a rotating member rotatably mounted thereto and an arcuate slot defined therein. The rotating member may securely engage with one of the first end and the second end of the article to be displayed to rotate therewith.

A driving mechanism is provided to drive the rotating member. The driving mechanism includes a driving means, a transmission means driven by the driving means and connected to the rotating member to move therewith, and a retaining member secured to the transmission means to move therewith and slidable along the slot, whereby rotational movement of the motor causes reciprocating sliding movement of the retaining member along the slot. The intermediate portion of the article to be displayed is retained by the retaining member.

Preferably, a handle is mounted to one of the first body and the second body for grasp. The second body may further include a base frame pivotally mounted to the second end thereof, and the first body may further include a recess defined therein for receiving an end of the base frame when the displaying device is in a display position. In addition, means is provided for securely retaining the first body and the second body in a closed position when not in a displaying position.

Other objects, advantages, and novel features of the invention will become more apparent from the following detailed description when taken in conjunction with the accompanying drawings.

DESCRIPTION OF THE PREFERRED EMBODIMENT

Figure 1:
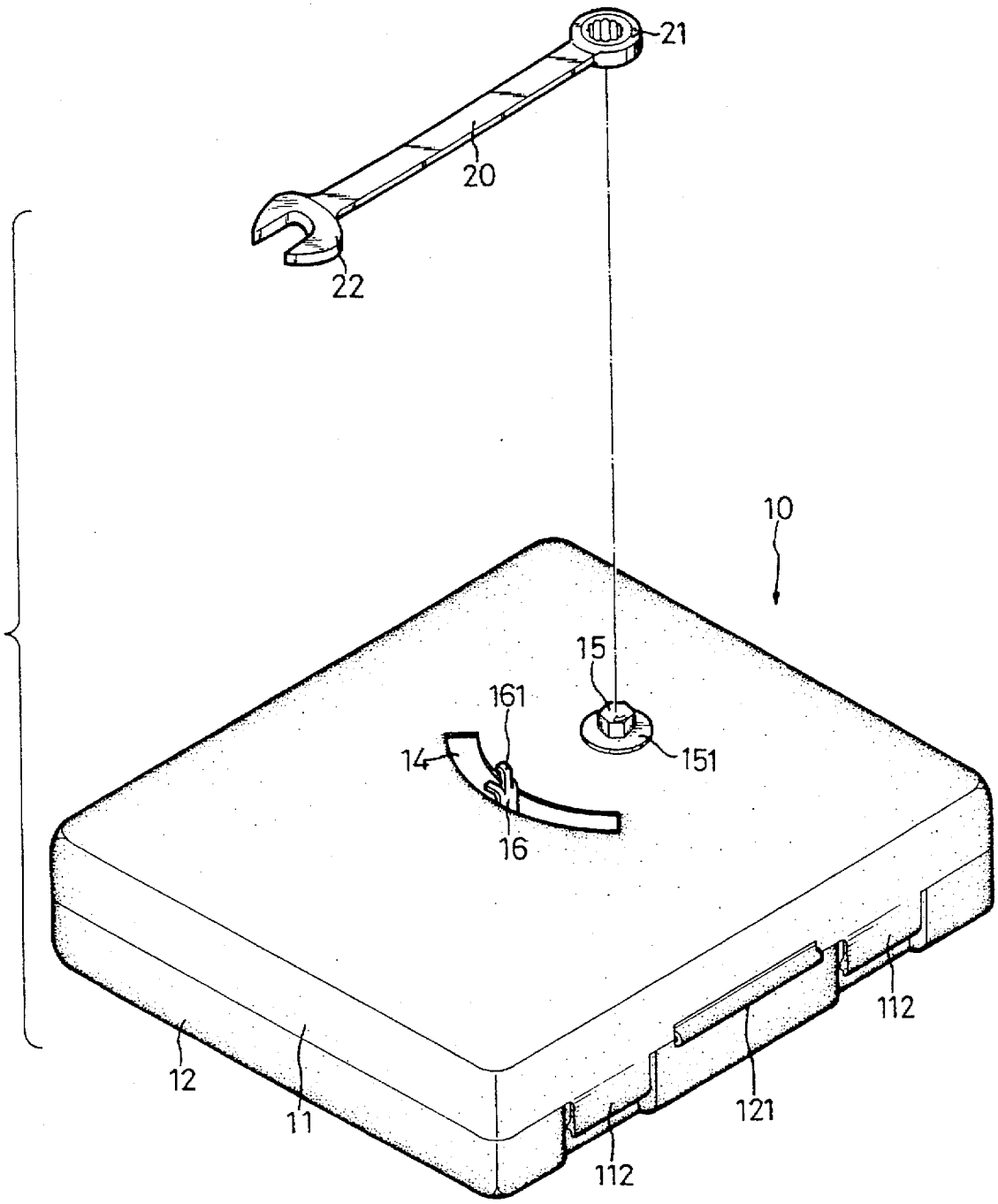
FIG. 1 is a perspective view of a displaying device in accordance with the present invention and a combination wrench.
Figure 2:
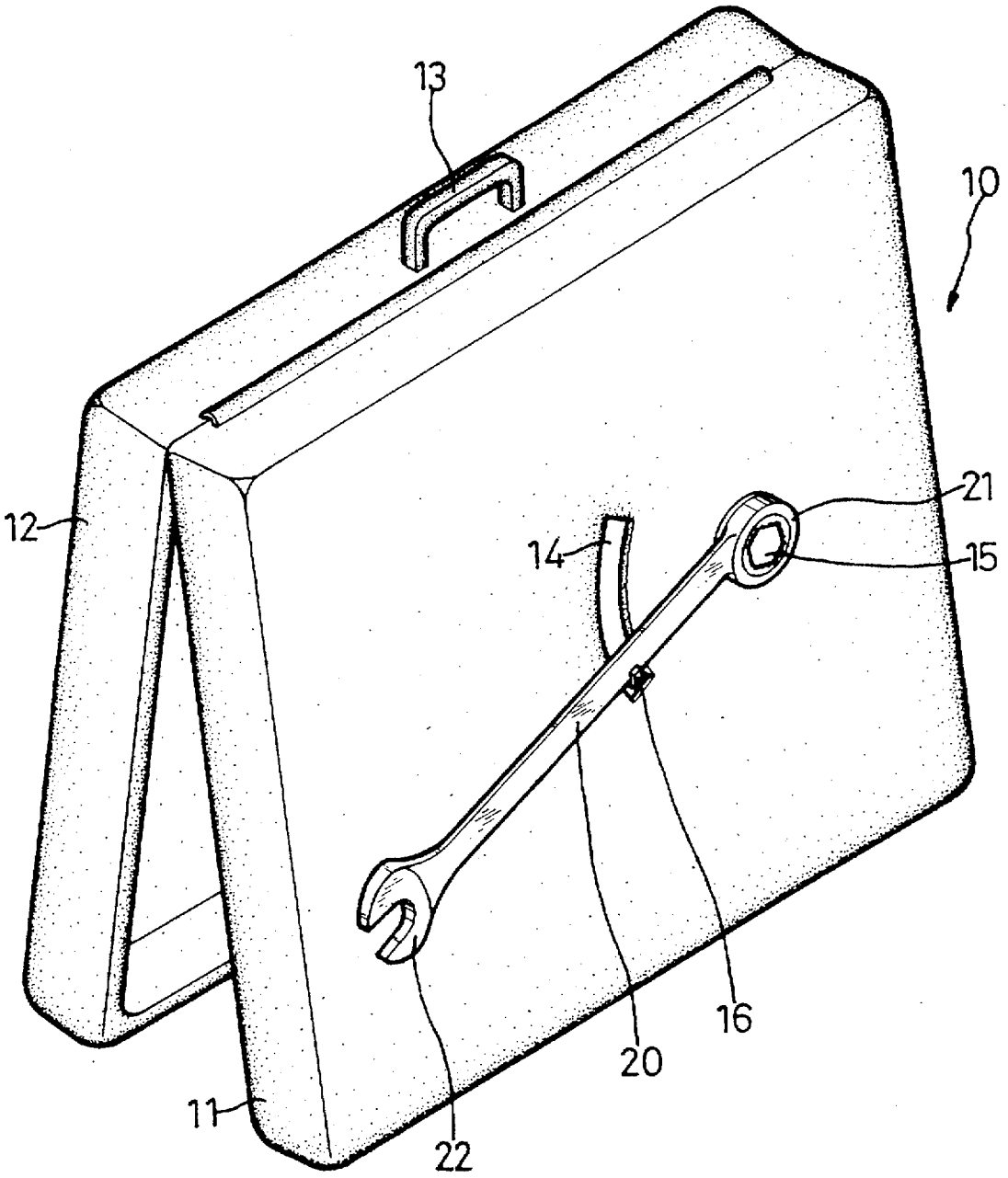
FIG. 2 is a perspective view of the displaying device in an opened status and with the combination wrench displayed thereon.
Figure 3:
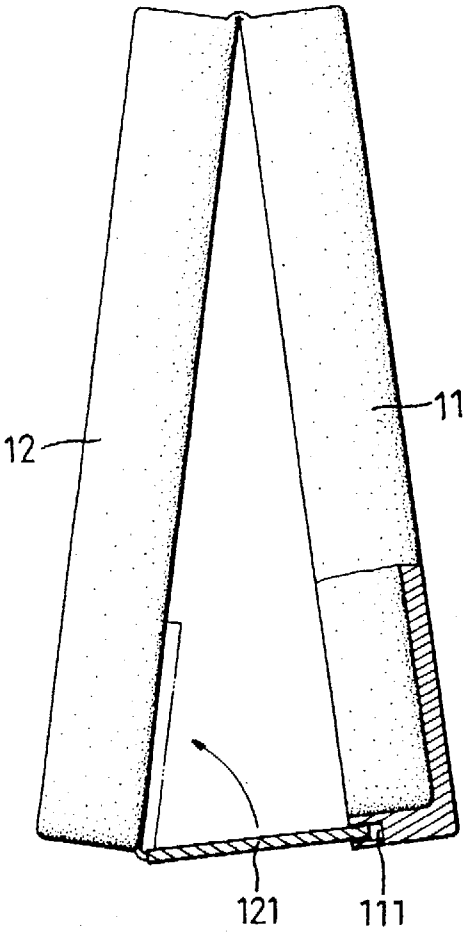
FIG. 3 is a side view, partially sectioned, of the displaying device.

Referring to the drawings and initially to FIGS. 1 to 3, a displaying device in accordance with the present invention is designated by reference numeral "10" and generally includes a first body 11 and a second body 12 which has a first end pivotally connected to a first end of the first body 11. A handle 13 may be provided to one of the bodies 11, 12 for grasp. As shown in FIG. 3, the second body 12 has a base plate 121 pivotally mounted to a second end thereof, while a second end of the first body 11 includes a recess 111 defined therein for releasably receiving an end of the base plate 121. When in a display position, the base plate 121 is in a position shown in FIG. 3 to provide a stable support for the displaying device 10. When in a storage position, the base frame 121 is pivoted to a position shown by phantom lines in FIG. 3 to thereby allow closing of first and second bodies 11 and 12 (FIG. 1). In addition, two engaging members 112 are provided for securing the bodies 11 and 12 together.

Figure 6:
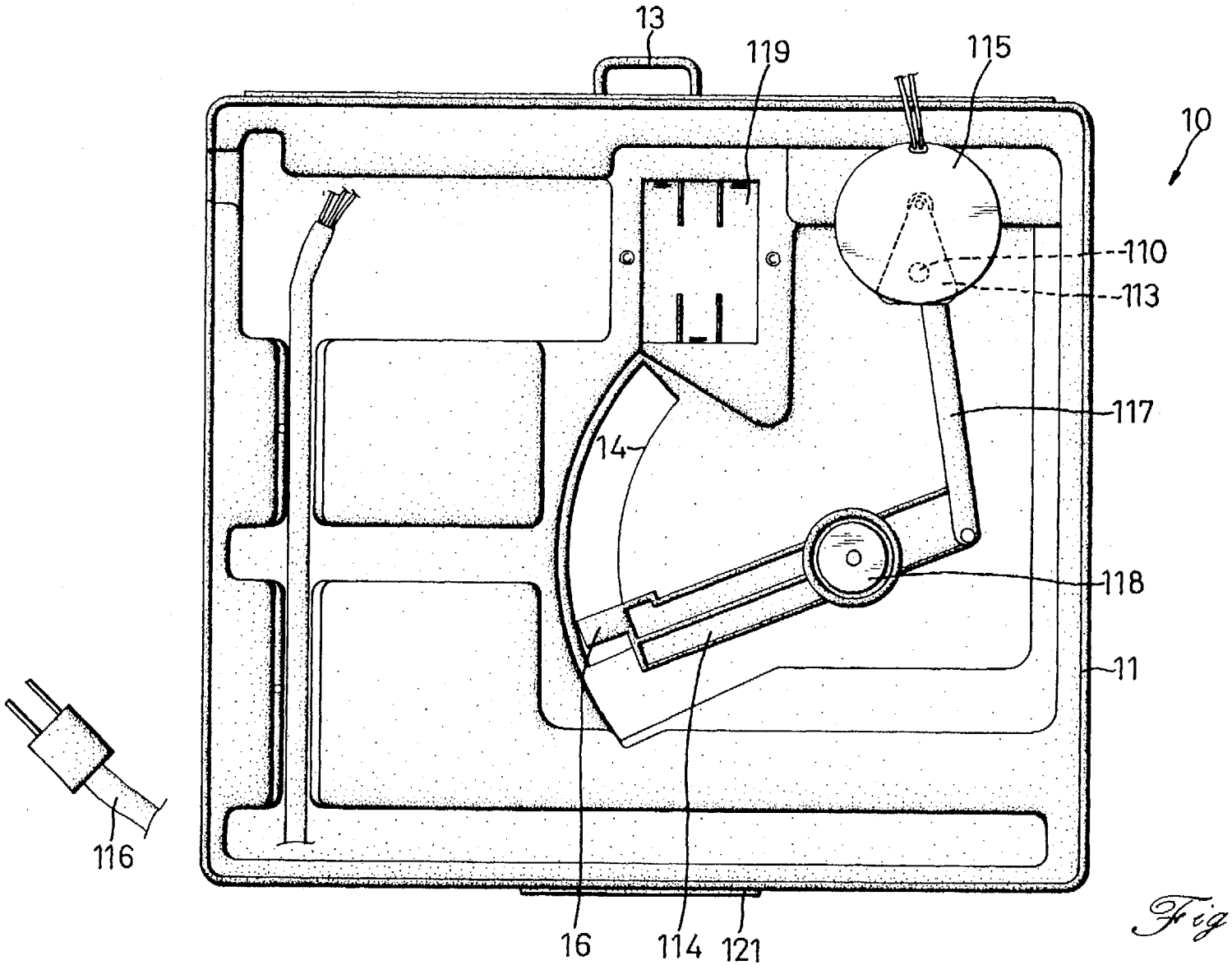
FIG. 6 is a plan view illustrating an interior of the displaying device.

The first body 11 further includes an arcuate slot 14 defined therein and a rotating member 151 rotatably mounted thereto. An engaging member 15 is formed on an outer side of the rotating member 151 to rotate therewith. FIG. 6 shows detailed structure of a driving mechanism for driving a combination wrench 20 to be displayed. The driving mechanism includes a motor 115 having an output shaft 110, a plate 113 driven by the output shaft 110 of the motor 115 and includes an end connected to an end of a link 117. A crank 114 includes a first end connected to the other end of the link 117 and a second end having a retaining member 16 formed thereon. The crank 114 is integral with the rotating member 151 at 118 or the rotating member 151 is secured to the crank 114 at 118 by any conventional means. The motor 115 may be driven by an external power source (via an electrical wire 116) or a battery unit (not shown) mounted in a compartment 119 defined in the first body 11 for receiving batteries therein.

Figure 5:
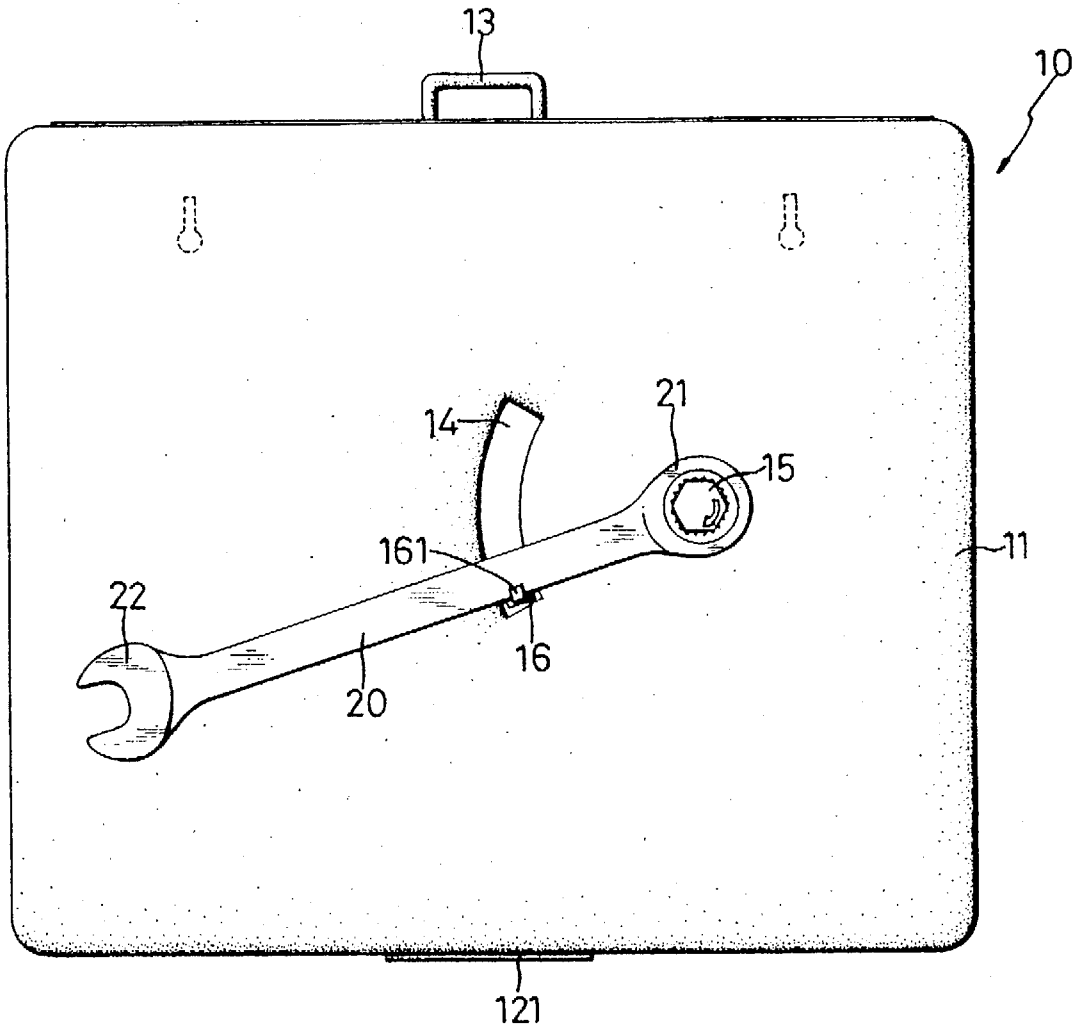
FIG. 5 is a view similar to FIG. 4, wherein the position of the combination wrench is changed.
Figure 4:
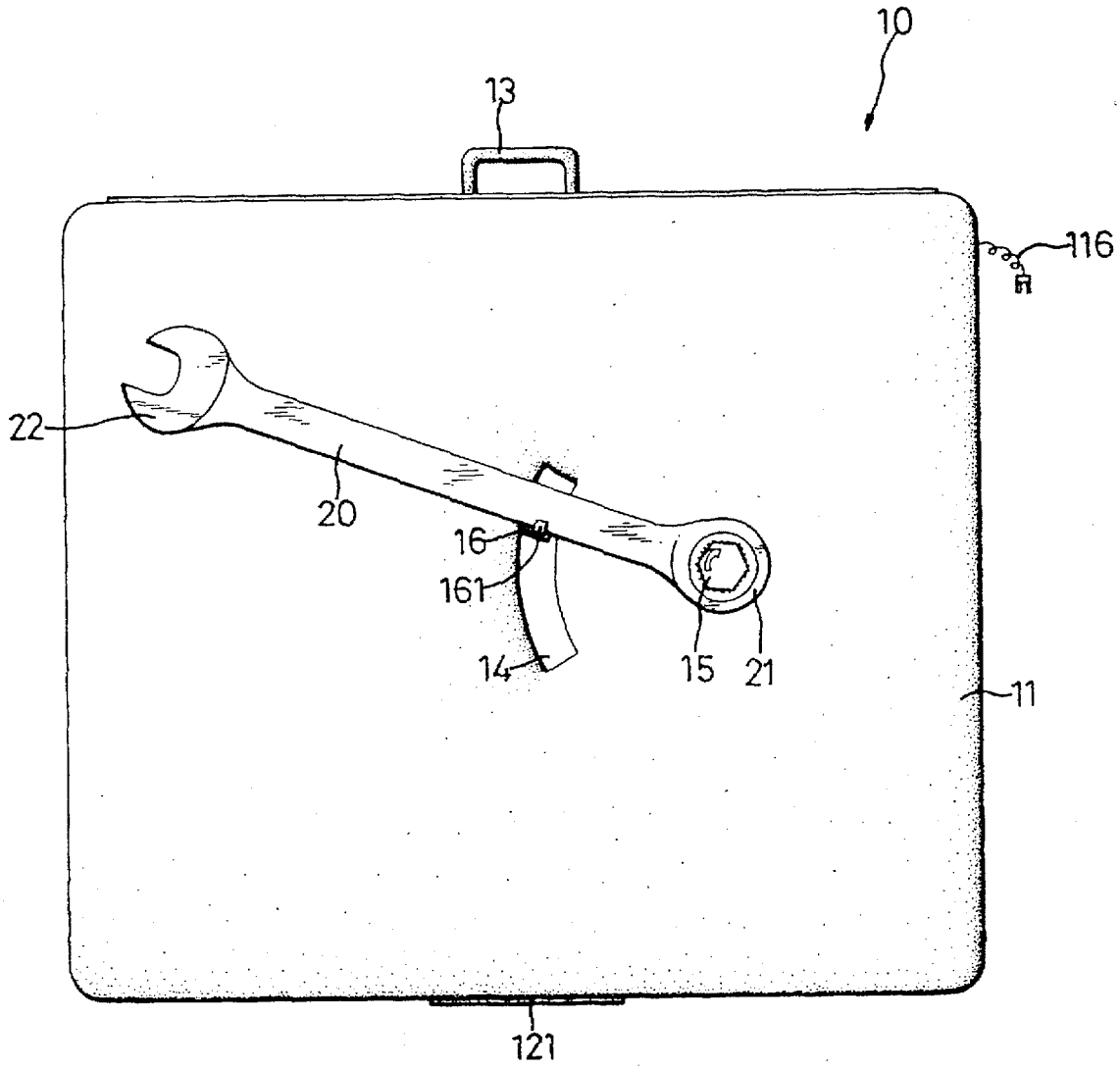
FIG. 4 is a front view of the displaying device with the combination wrench displayed thereon.
Figure 7:
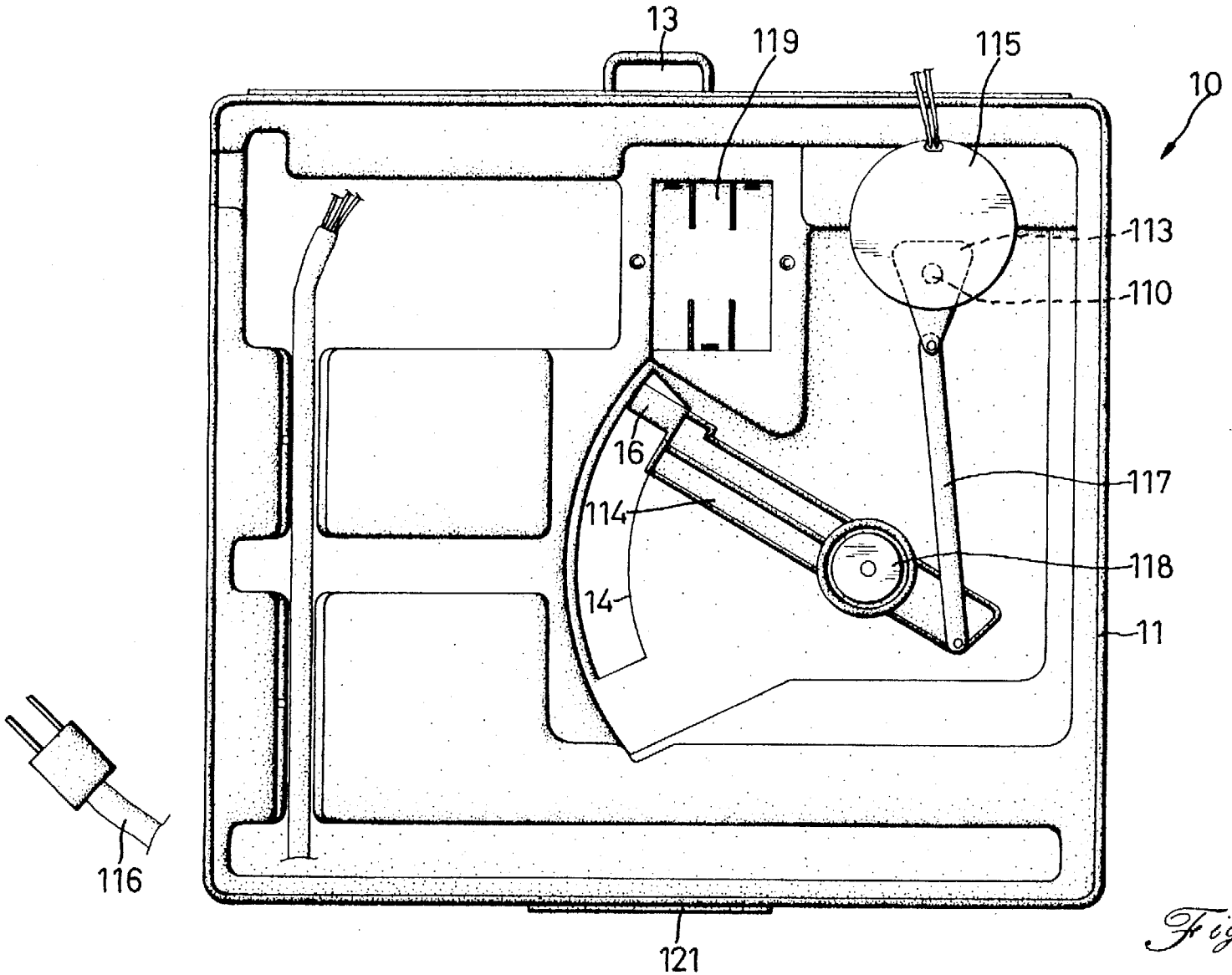
FIG. 7 is a view similar to FIG. 6, wherein the position of the combination wrench is changed.

In use, referring to FIG. 2, a combination wrench 20 having a box end 21 and a jaw end 22 is displayed on the displaying device 10 with the box end 21 secured on the engaging member 15 to move therewith, while a portion of a handle of the combination wrench 20 is held by the retaining member 16. When the motor 115 is activated, via transmission of the plate 113, the link 117, and the crank 114, the retaining member 16 slides along the slot 14, while the whole combination wrench 20 pivots reciprocatingly about the engaging member 15 to thereby attract the buyers. FIGS. 4 and 5 illustrate movements of the combination wrench 20, and FIGS. 6 and 7 illustrate movements of the driving mechanism.

According to the above description, it is appreciated that the present invention provides a portable displaying device for displaying a combination wrench, socket wrench, etc. to attract the buyers as the displayed commodity is readily touchable.

Although the invention has been explained in relation to its preferred embodiment, it is to be understood that many other possible modifications and variations can be made without departing from the spirit and scope of the invention as hereinafter claimed.

What is claimed is:

1. A displaying device for an article having a first end, a second end, and an intermediate portion between the first end and the second end, comprising:

a first body having a first end and a second end, the first body further including a rotating member rotatably mounted thereto and an arcuate slot defined therein, the rotating member being adapted to securely engage with one of the first end and the second end of the article to be displayed to rotate therewith, a second body having a first end pivotally connected to the first end of the first body and a second end, and a driving mechanism including a driving means, a transmission means driven by the motor and connected to the rotating member to move therewith, and a retaining member secured to the transmission means to move therewith and slidable along the slot, whereby rotational movement of the motor causes reciprocating sliding movement of the retaining member along the slot, the retaining member being adapted to retain the intermediate portion of the article to be displayed.

2. The displaying device according to claim 1, further comprising a handle mounted to one of either the first body or the second body.

3. The displaying device according to claim 1, wherein the second body further includes a base frame pivotally mounted to the second end thereof.

4. The displaying device according to claim 3, wherein the first body further includes a recess defined therein for receiving an end of the base frame when the displaying device is in a display position.

5. The displaying device according to claim 1, further comprising means for securely retaining the first body and the second body in a closed position when not in a displaying position.

6. A displaying device for a wrench having a box end and a shank, comprising:

a first body having a first end and a second end, the first body further including a rotating member rotatably mounted thereto and an arcuate slot defined therein, the rotating member being adapted to securely engage with the box end of the wrench to be displayed to rotate therewith, a second body having a first end pivotally connected to the first end of the first body and a second end, and a driving mechanism including a driving means, a transmission means driven by the driving means and connected to the rotating member to move therewith, and a retaining member secured to the transmission means to move therewith and slidable along the slot, whereby rotational movement of the driving means causes reciprocating sliding movement of the retaining member along the slot, the retaining member being adapted to retain the shank of the wrench to be displayed.

* * * * *